US010029281B2

(12) United States Patent
Knepp et al.

(10) Patent No.: US 10,029,281 B2
(45) Date of Patent: Jul. 24, 2018

(54) WIRE SCREENINGS AND A METHOD OF FORMING THE SAME

(71) Applicant: Lumsden Corporation, Lancaster, PA (US)

(72) Inventors: Boyd E. Knepp, Lancaster, PA (US); Myron Henry Wardell, Lititz, PA (US); Jeffery L. Beck, Honey Brook, PA (US)

(73) Assignee: Lumsden Corporation, Lancaster, PA (US)

( * ) Notice: Subject to any disclaimer, the term of this patent is extended or adjusted under 35 U.S.C. 154(b) by 142 days.

(21) Appl. No.: 14/886,186

(22) Filed: Oct. 19, 2015

(65) Prior Publication Data

US 2016/0038977 A1 Feb. 11, 2016

Related U.S. Application Data

(63) Continuation-in-part of application No. 13/946,207, filed on Jul. 19, 2013, now Pat. No. 9,486,837.

(51) Int. Cl.
*B07B 1/49* (2006.01)
*B07B 1/46* (2006.01)
(Continued)

(52) U.S. Cl.
CPC ..... *B07B 1/4672* (2013.01); *B07B 1/4618* (2013.01); *B21F 27/02* (2013.01); *B21F 27/18* (2013.01); *B07B 1/46* (2013.01)

(58) Field of Classification Search
CPC ..... B07B 1/12; B07B 1/46; B07B 1/4663; B07B 1/4672; B07B 1/48
(Continued)

(56) References Cited

U.S. PATENT DOCUMENTS 2,962,057 A 11/1960 Webber
3,094,302 A * 6/1963 Stauffer ..... B07B 1/4672 139/425 R
(Continued)

FOREIGN PATENT DOCUMENTS

GB 2185698 7/1987
WO 2004/048005 6/2004

OTHER PUBLICATIONS

U.S. Appl. No. 13/946,207, filed Jul. 19, 2013.
(Continued)

*Primary Examiner* — Joseph C Rodriguez
*Assistant Examiner* — Kalyanavenkateshware Kumar
(74) *Attorney, Agent, or Firm* — Merek, Blackmon & Voorhees, LLC

(57) ABSTRACT

A wire screening for classifying material. The screening may include a plurality of interwoven warp and weft wires where the weft wires are individually coated with a coating that expands and collapses to enhance performance and longevity of the screen. The coating of one or more weft wires may differ in at least one characteristic from the coating of one or more other weft wires. The warp wires can be individually coated to enhance performance and/or longevity of the screening. Binding blocks can be used in place of weft wires. The coating of one or more warp wires may differ in at least one characteristic from the coating of one or more other warp wires and/or one or more weft wires. The screening can include a plurality of uncoated weft and warp wires where the crimp depth of each wire forming each opening has a different crimp depth.

26 Claims, 14 Drawing Sheets

(51) Int. Cl.
*B21F 27/02* (2006.01)
*B21F 27/18* (2006.01)

(58) Field of Classification Search
USPC ..... 209/233, 392, 400–403; 139/245 R, 139/245 A
See application file for complete search history.

(56) References Cited

U.S. PATENT DOCUMENTS 3,175,792 A 3/1965 Smallian
5,037,537 A * 8/1991 Bielagus ..... B07B 1/28 198/630
5,819,952 A * 10/1998 Cook ..... B01D 33/0376 209/400
7,581,569 B2 * 9/2009 Beck ..... B07B 1/4672 139/425 A
9,486,837 B2 11/2016 Wardell et al.
2004/0102117 A1 * 5/2004 Carr ..... B07B 1/4618 442/229
2009/0294334 A1 * 12/2009 Knepp ..... B07B 1/4672 209/401
2013/0068668 A1 * 3/2013 Beck ..... B07B 1/4672 209/392
2014/0102953 A1 * 4/2014 Steadman ..... B07B 1/4672 209/409
2015/0021240 A1 1/2015 Wardell et al.

OTHER PUBLICATIONS

GIRON, "Abrasion and screening surfaces", three pages, May 1993 (NPL1).
GIRON, "Wire Screens, Steel-Polyurethane-Rubber" six pages (NPL2).
Excerpt from GIRON website downloaded from Internet Archive WayBack Machine at https://web.archive.org/web/20081118133323/http://www.giron.fr/english/news/news.htm, 1 page (NPL3).
Excerpt from GIRON website downloaded from Internet Archive WayBack Machine at https://web.archive.org/web/20081119001146/http://www.giron.fr/english/screen-mesh/polymixte.htm, 1 page (NPL4).

* cited by examiner

WIRE SCREENINGS AND A METHOD OF FORMING THE SAME

RELATED APPLICATION

The subject patent application is a continuation-in-part of U.S. patent application Ser. No. 13/946,207 filed on Jul. 19, 2013, the entire contents of which are incorporated herein by reference.

FIELD OF THE INVENTION

The present invention is directed to wire screenings and a method of forming the same. More particularly, a preferred embodiment of the present invention is directed to wire screenings used in a shaker or vibrating screen apparatus that classify material flowing through one or more wire screenings or screens.

BACKGROUND OF THE INVENTION

One or more woven or non-woven wire screens have been used in shaker or vibrating screen apparatus to size material passing through the wire screens. Known woven wire screens typically consist of a plurality of interwoven weft and warp wires forming a plurality of openings for permitting suitably sized material to pass through the screen. The openings can be square or rectangular. Alternatively, the screen can be formed as a long slot screen where the warp wires are maintained in spaced parallel relation by weft wires arranged in groups of three at spaced intervals along the length of the warp wires. It is conventional to coat the weft wires in certain types of woven wires screens with polyurethane blocks where each polyurethane block completely surround a set of three weft wires to protect the weft wires from wear. It is also conventional to use a plurality of polyurethane blocks as the sole means for binding the warp wires, i.e., no weft wires are used. These latter types of screenings (i.e., screenings lacking any weft wires) are referred to herein as non-woven wire screenings. The phrases "wire screening" and "wire screen" as used herein include woven and non-woven wire screenings or screens.

Conventional woven and non-woven wire screens have limited efficiency due to the limited throughput of product through known woven and non-woven wire screens for a given period of time. The preferred forms of the present invention are designed to significantly improve the throughput and thereby significantly improve the efficiency of wire screens.

OBJECTS AND SUMMARY OF THE INVENTION

An object of the present invention is to provide a novel and unobvious wire screening and a method of forming the same.

Another object of a preferred embodiment of the present invention is to provide a wire screening having an upper screening surface configured to improve the tumbling action of product impacting the upper screening surface to improve the throughput of the wire screening.

A further object of a preferred embodiment of the present invention is to provide a wire screening configured to obtain greater throughput than a conventional screen having the same open area.

Yet another object of a preferred embodiment of the present invention is to provide a woven wire screening with a plurality of interwoven weft and warp wires forming a plurality of openings where each wire forming each of the plurality of openings has a different crimp depth than every other wire forming each of the plurality of openings.

Still another object of a preferred embodiment of the present invention is to provide a woven wire screening that includes a plurality of weft wires and a plurality of warp wires where the weft wires are individually coated with a flexible protective material that expands and contracts when objects impact the screening when in use to enhance vibrational movement of the warp wires to improve the performance of the screening.

Yet still another object of a preferred embodiment of the present invention is to provide a woven wire screening that includes a plurality of weft wires and a plurality of warp wires where the weft wires are individually coated with a protective material to enhance vibrational movement of the warp wires to improve the performance of the screening.

A further object of a preferred embodiment of the present invention is to provide a wire screening where at least some of the wires are individually coated and the coating of at least one wire differs in at least one characteristic from the coating of at least one other wire to improve performance of the screening.

Still another object of a preferred embodiment of the present invention is to provide a wire screening having at least one set of individually coated wires where the center of the wire is offset from the center of the coating.

Yet another object of a preferred embodiment of the present invention is to provide a wire screening having at least one set of individually coated wires where the coating has a non-uniform thickness.

Still another object of the present invention is to provide a wire screening having individually coated wires where the thickness of the coating of one wire differs from the thickness of the coating of at least one other wire to improve tumbling action of objects impacting the screening during use.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to a woven wire screening for use in classifying material flowing through the woven wire screening including a first set of warp wires. Each warp wire in the first set of warp wires extending parallel to all other warp wires in the first set of warp wires. At least two warp wires in the first set of warp wires are crimped wires. A second set of crimped weft wires extending perpendicular to the first set of warp wires and a third set of crimped weft wires extending perpendicular to the first set of warp wires. The first set of warp wires, the second set of crimped weft wires and the third set of crimped weft wires are interwoven to form an integral wire cloth having a plurality of openings for permitting material to be classified to flow through the openings. The second and third sets of crimped weft wires each include at least three crimped weft wires. One of the crimped weft wires in the second set of crimped weft wires are spaced from an adjacent crimped weft wire in the second set of crimped weft wires a first distance and the second set of crimped weft wires are spaced from the third set of crimped weft wires a second distance wherein the second distance is greater than the first distance and no weft wires are positioned between the second set of crimped weft wires and the third set of crimped weft wires. At least three individual protective coatings where each coating is formed about only one of the at least three crimped weft wires in the second set of crimped weft wires such that each of the at least three crimped weft wires in the second set of crimped weft wires has a separate coating from each of the other of the at least three crimped weft wires in the second set of crimped weft wires. Each of the at least three individual protective coatings is formed from a non-metallic material.

Another preferred embodiment of the present invention is directed to a wire screening for use in classifying material flowing through the wire screening including a first set of wires. Each wire in the first set of wires extends parallel to all other wires in the first set of wires. A second set of members extending perpendicular to the first set of wires. The first set of wires and the second set of members are connected to form an integral wire cloth having a plurality of openings for permitting material to be classified to flow through the openings. An individual protective coating formed on each of the wires in the first set of wires. The individual protective coating is formed from a non-metallic material having a thickness which varies over a perimeter of the individual protective coating such that a first portion of the individual protective coating formed on a first portion of a corresponding wire has a thickness greater than a second portion of the individual protective coating formed on a second portion of the corresponding wire.

A further preferred embodiment of the present invention is directed to a woven wire screening for use in classifying material flowing through the woven wire screening including a first set of warp wires. Each warp wire in the first set of warp wires extending parallel to all other warp wires in the first set of warp wires. A second set of weft wires extending perpendicular to the first set of warp wires. The first set of warp wires and the second set of weft wires are interwoven to form an integral wire cloth having a plurality of openings for permitting material to be classified to flow through the openings. An individual protective coating formed on one of the following: (i) each of the warp wires in the first set of warp wires and (ii) each of the weft wires in the second set of weft wires. The individual protective coating is formed from a non-metallic material and has a non-circular cross-section with a first portion of the individual protective coating formed on a top surface of a corresponding wire and a second portion of the individual protective coating formed on a bottom surface of the corresponding wire.

Still another preferred embodiment of the present invention is directed to a wire screening for use in classifying material flowing through the wire screening including a first set of wires. Each wire in the first set of wires extends parallel to all other wires in the first set of wires. A second set of members extending perpendicular to the first set of wires. The first set of wires and the second set of members are connected to form an integral wire cloth having a plurality of openings for permitting material to be classified to flow through the openings. A first set of individual protective coatings wherein one individual protective coating of the first set of individual protective coatings is formed on each of the wires in the first set of wires. At least one individual protective coating in the first set of individual protective coatings has at least one characteristic that differs from another individual protective coating in the first set of individual protective coatings.

Still a further preferred embodiment of the present invention is directed to a woven wire screening for use in classifying material flowing through the woven wire screening including a first set of wires. Each wire in the first set of wires extends parallel to all other wires in the first set of wires. A second set of wires extending perpendicular to the first set of wires. The first set of wires and the second set of wires are interwoven to form an integral wire cloth having a plurality of openings for permitting material to be classified to flow through the openings. The plurality of openings includes a first opening formed from two wires of the first set of wires and two wires from the second set of wires and wherein each wire forming the first opening has a different crimp depth different from each other wire forming the first opening.

A further preferred embodiment of the present invention is directed to a woven wire screening for use in classifying material flowing through the woven wire screening including a first set of wires. Each wire in the first set of wires extends parallel to all other wires in the first set of wires. A second set of wires extending perpendicular to the first set of wires. The first set of wires and the second set of wires are interwoven to form an integral wire cloth having a plurality of openings for permitting material to be classified to flow through the openings. A first set of individual protective coatings wherein one individual protective coating of the first set of individual protective coatings is formed on each of the wires in the first set of wires. A second set of individual protective coatings wherein one individual protective coating of the second set of individual protective coatings is formed on each of the wires in the second set of wires. At least one individual protective coating in the first set of individual protective coatings has at least one characteristic that differs from at least one individual protective coating of the second set of individual protective coatings.

BRIEF DESCRIPTION OF THE DRAWINGS

FIG. 8 is an enlarged cross-sectional view taken along the longitudinal axis (i.e., an axis extending parallel to the warp wires) of the woven wire screen of FIG. 6 with an alternative coating for the weft wires to that shown in FIGS. 6 and 7.

FIGS. 16 to 18 are each a cross-sectional view through either the warp or weft wires of the woven wire screening depicted in FIG. 13 with different coating configurations.

DETAILED DESCRIPTION OF THE PREFERRED EMBODIMENTS OF THE INVENTION

The preferred forms of the invention will now be described with reference to FIGS. 1 through 21. The appended claims are not limited to the preferred forms and no term and/or phrase used herein is to be given a meaning other than its ordinary meaning unless it is expressly stated that the term and/or phrase shall have a special meaning.

FIGS. 1-5

Referring to FIGS. 1 to 4, a woven wire screening or screen A formed in accordance with a preferred embodiment of the present invention is illustrated in one of many possible configurations. Screen A includes a plurality of warp wires 2 and a plurality of weft wires 4. Weft wires 4 are also referred to as fill wires. The weft or fill wires 4 and the warp wires 2 are interwoven to form a plurality of openings 6. Preferably, openings 6 are diamond shaped. However, the shape of the openings can be readily varied as desired. The weft wires 4 and the warp wires 2 can have a circular cross-section. Alternatively, warp wires 2 and/or weft wires 4 can be shaped wires having two substantially flat vertically extending side walls. Other wire configurations may be used as desired.

Figure 1:
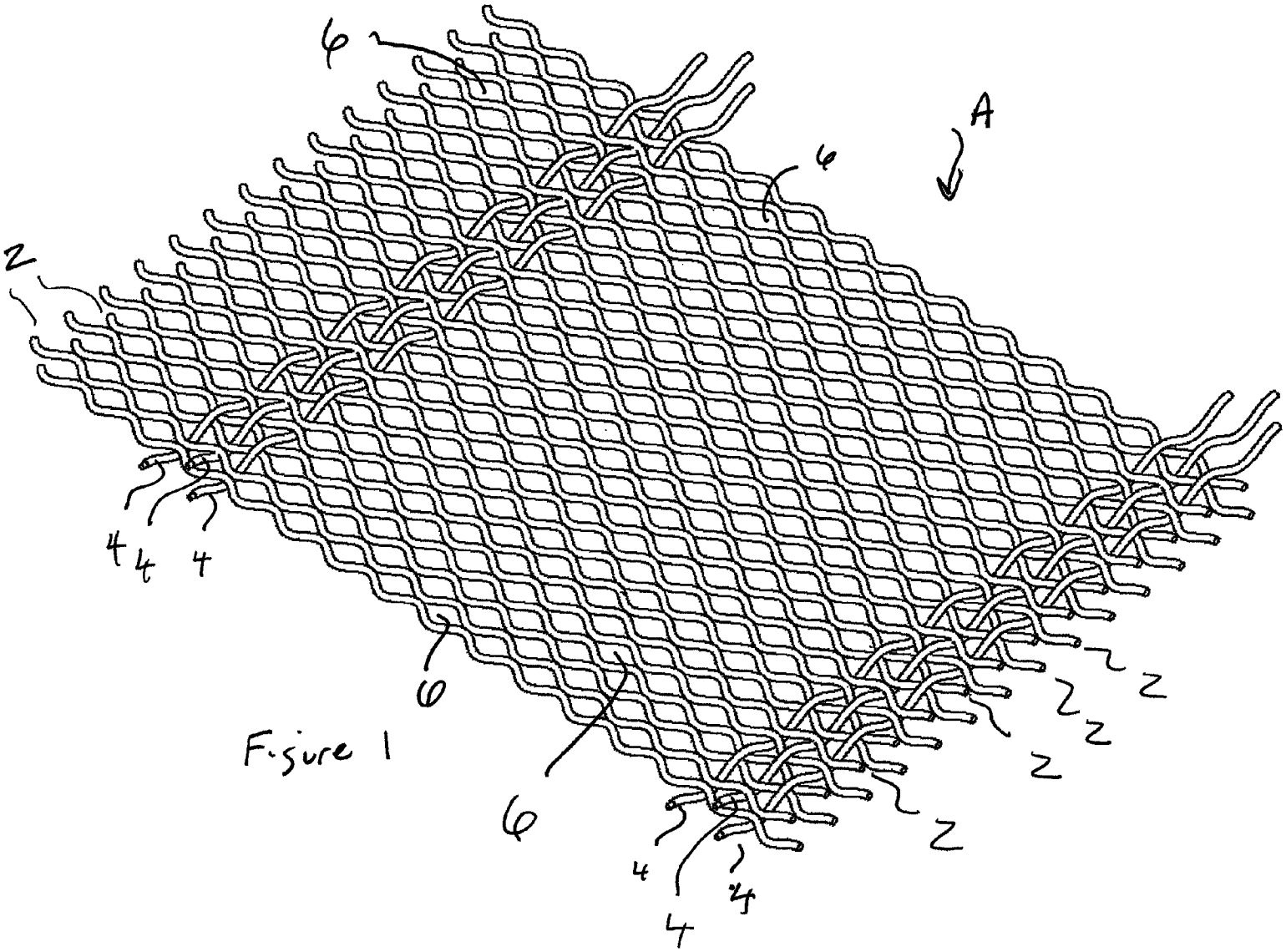
FIG. 1 is a perspective view of a portion of a woven wire screening formed in accordance with a preferred embodiment of the present invention where the weft wires are individually coated with a flexible material and the warp wires are preferably uncoated.
Figure 2:
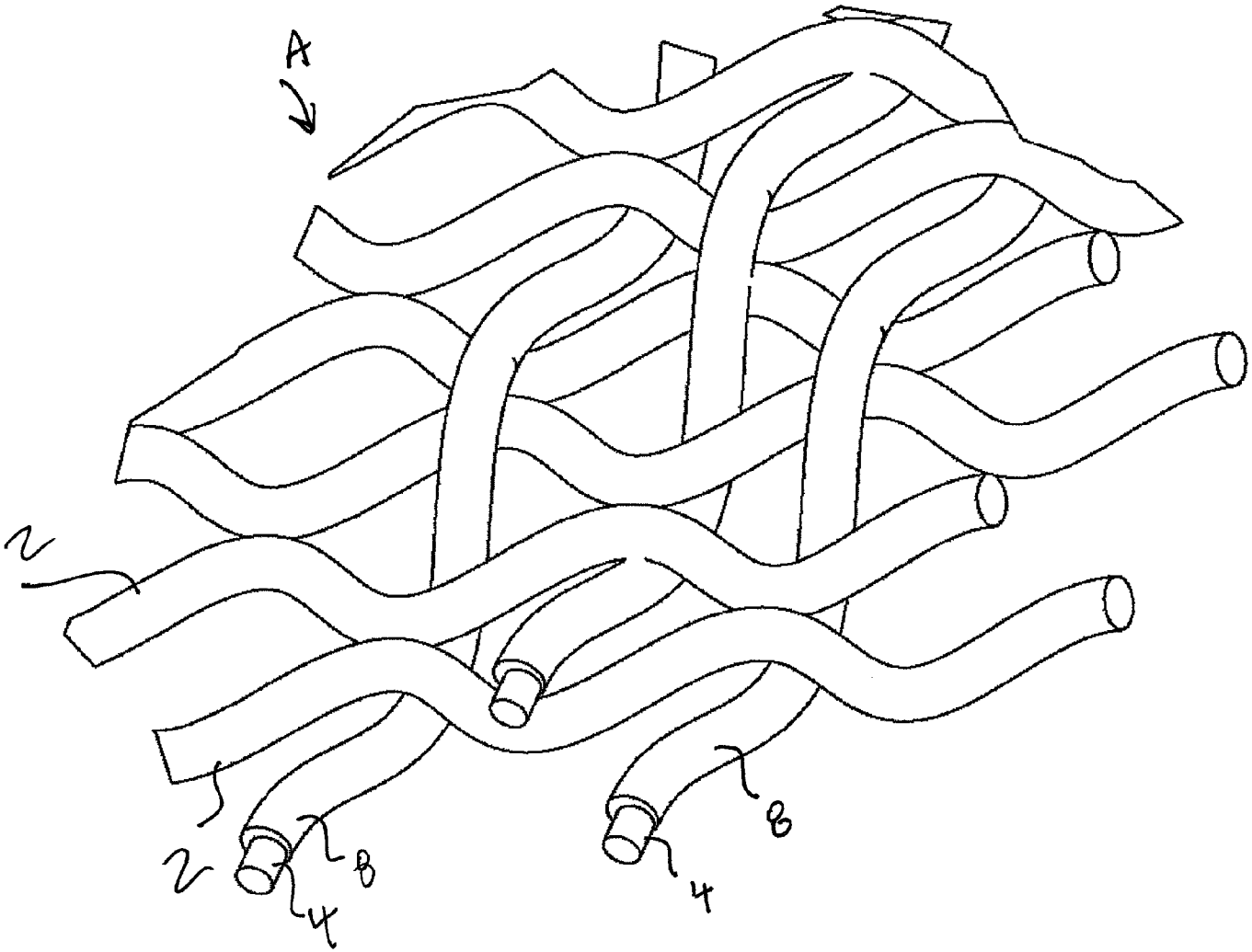
FIG. 2 is an enlarged view of a portion of the woven wire screen of FIG. 1.
Figure 3:
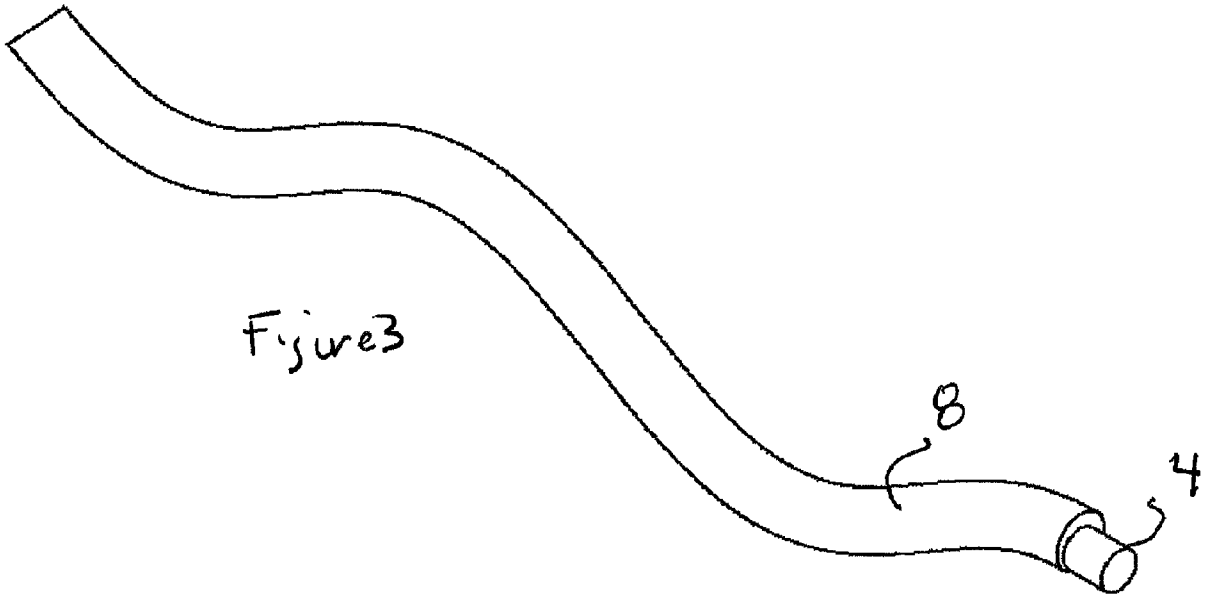
FIG. 3 is an enlarged perspective view of a portion of a weft wire of the woven wire screen of FIG. 1.
Figure 4:
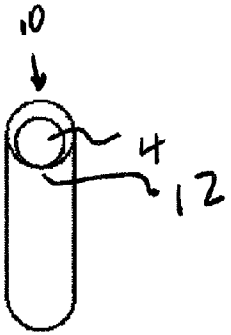
FIG. 4 is an enlarged end view of a weft wire of the woven wire screen of FIG. 1.
Figure 5:
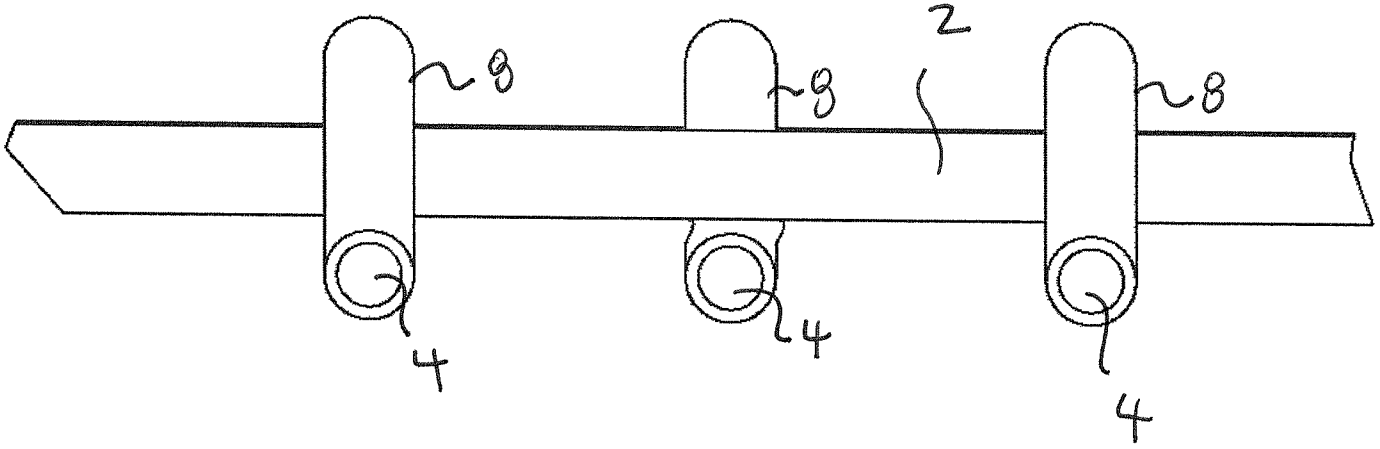
FIG. 5 is an enlarged cross-sectional view taken along the longitudinal axis (i.e., an axis extending parallel to the warp wires) of the woven wire screen of FIG. 1 with a different coating and wire orientation than shown in FIGS. 1 to 4.

Preferably, the weft wires 4 are grouped in sets of at least three weft wires. The distance between groups of weft wires is considerably greater than the distance between each weft wire in a grouping of weft wires as seen in FIG. 1. Preferably, each of the weft wires 4 are individually coated with a protective coating 8. The coating can be applied prior or subsequent to weaving of the warp and weft wires. The individually coatings 8 increase the relative movement of the warp wires 2 to enhance performance of the screening. Coating 8 is preferably formed from a flexible material that expands and collapses during use of the screening to further enhance the relative movement of the warp wires 4 to enhance performance of the screening. However, the hardness characteristic of the coating may be varied as desired. The coating 8 may be formed from any suitable material including but not limited to polyurethane. As seen in FIGS. 2 through 4, the coating 8 may be applied to the weft wires 4 such that the center of the coating 8 is offset upwardly from the center of weft wires 4. Referring to FIGS. 2 to 4, this orientation of the coating and the corresponding weft wire results in the coating portion 10 formed about the top of weft wires 4 having a thickness greater than coating portion 12 formed about the bottom of weft wires 4. This configuration increases the height differential between the uppermost portion of the coated weft wires 4 and the uppermost portion of warp wires 2 to improve the tumbling action of objects impacting the screen during use of the screen to classify material flowing through the screen. As shown in FIG. 8, the thickness of the coating applied to one of the at least three weft wires may differ from the other two weft wires in a grouping of three or more weft wires to create a height differential between an uppermost portion of one weft wire and an uppermost portion of the other two weft wires in a grouping of three or more weft wires to improve the tumbling action of objects impacting the screen during use of the screen to classify material flowing through the screen. Further, the coating thickness of each of the weft wires in a grouping of three or more weft wires may differ from the coating thickness of all of the other weft wires in a grouping of three or more weft wires. As shown in FIG. 5, the center of coating 8 can be aligned with the center of the corresponding weft wire 4. While this configuration will increase the height differential between the uppermost portion of the coated weft wires and the uppermost portion of the warp wires, the height differential is not a great as when the center of the coating is offset upwardly from the center of the corresponding wire.

The warp wires 2 may be individually coated with any suitable material. The coating of the warp wires 2 may differ in at least one characteristic from the coatings formed on weft wires 4 to improve performance of the screen. For example, the coating applied to warp wires 2 may have a lower coefficient of friction than the coating formed on the weft wires 4 to facilitate objects passing through openings 6. The coating on the warp wires could be formed from TEFLON or a material having a similar coefficient of friction to TEFLON. Ribs or protrusions may be formed in the upper portions of the coatings formed on the weft wires 4 and/or the warp wires 2 to improve the tumbling action of the screen. It should be noted that where the warp wires are individually coated, the weft wires 4 could be replaced with polyurethane blocks as the sole means for binding the warp wires together, i.e., no weft or fill wires are present in screen A or each set of three or more weft wires 4 could be completely embedded in a polyurethane block. The polyurethane blocks can take the form depicted in FIG. 8 of U.S. Pat. No. 8,919,568 the entire contents of which are incorporated herein by reference. In this instance, the coatings of one or more warp wires may differ in at least one characteristic from one or more of the other warp wires. For example, every other warp wire could have a coating with an uppermost surface raised above the uppermost surface of a directly adjacent warp wire creating a height differential between adjacent warp wires to improve the tumbling action of the screen. This height differential can be achieved in a number of ways. For example, the coating thickness of every other warp wire could be greater than the coating thickness of the directly adjacent warp wires. Alternatively, every other warp wire could have a coating formed about the wire in the manner shown in FIGS. 2 through 4 and the directly adjacent warp wires could have a coating formed in the manner depicted in FIG. 5 where the diameters of all coatings on the warp wires are the same size.

FIGS. 6-10

Figure 6:
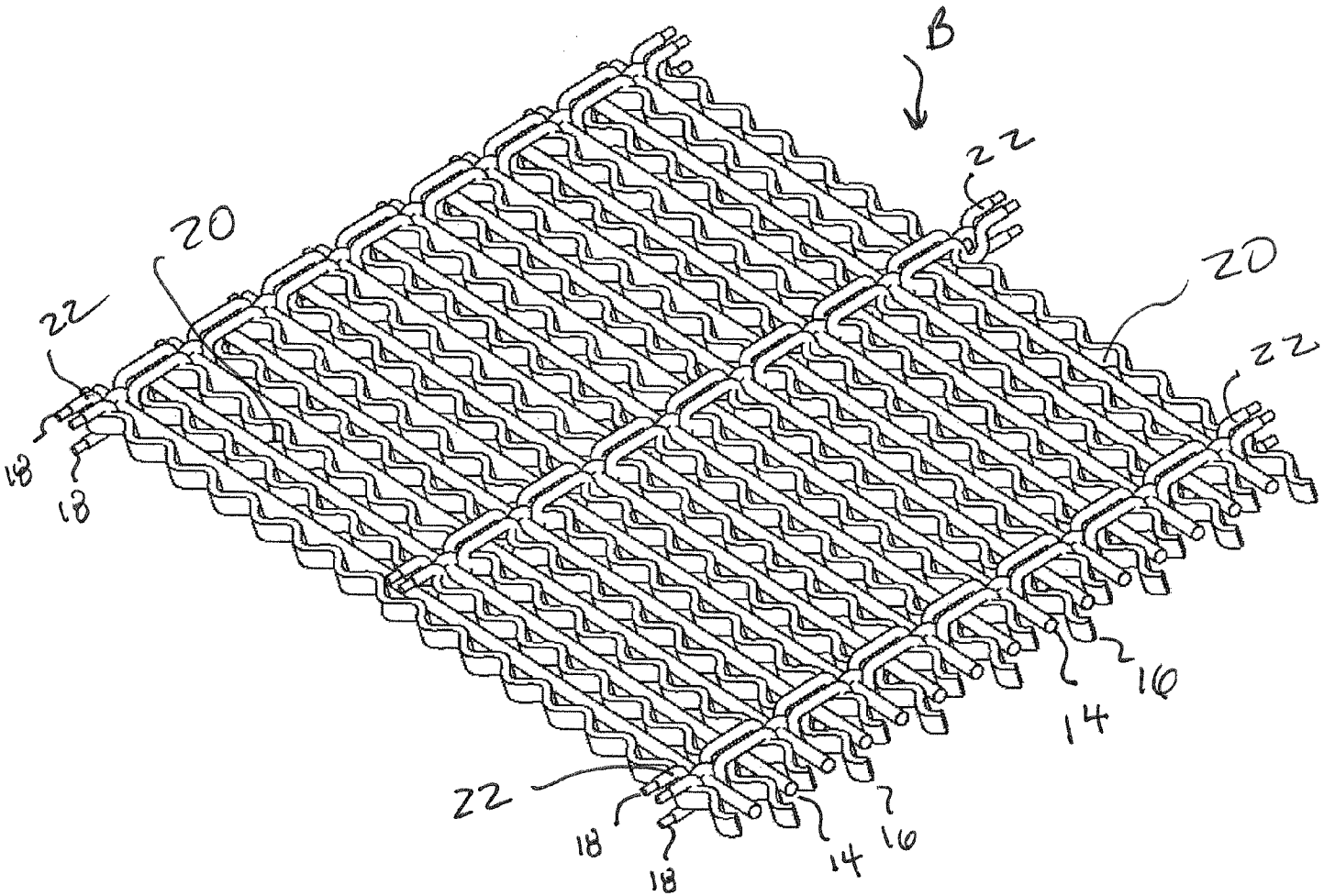
FIG. 6 is a perspective view of a portion of a woven wire screening formed in accordance with another preferred embodiment of the present invention where the weft wires are individually coated with a flexible material and the warp wires are preferably uncoated.
Figure 7:
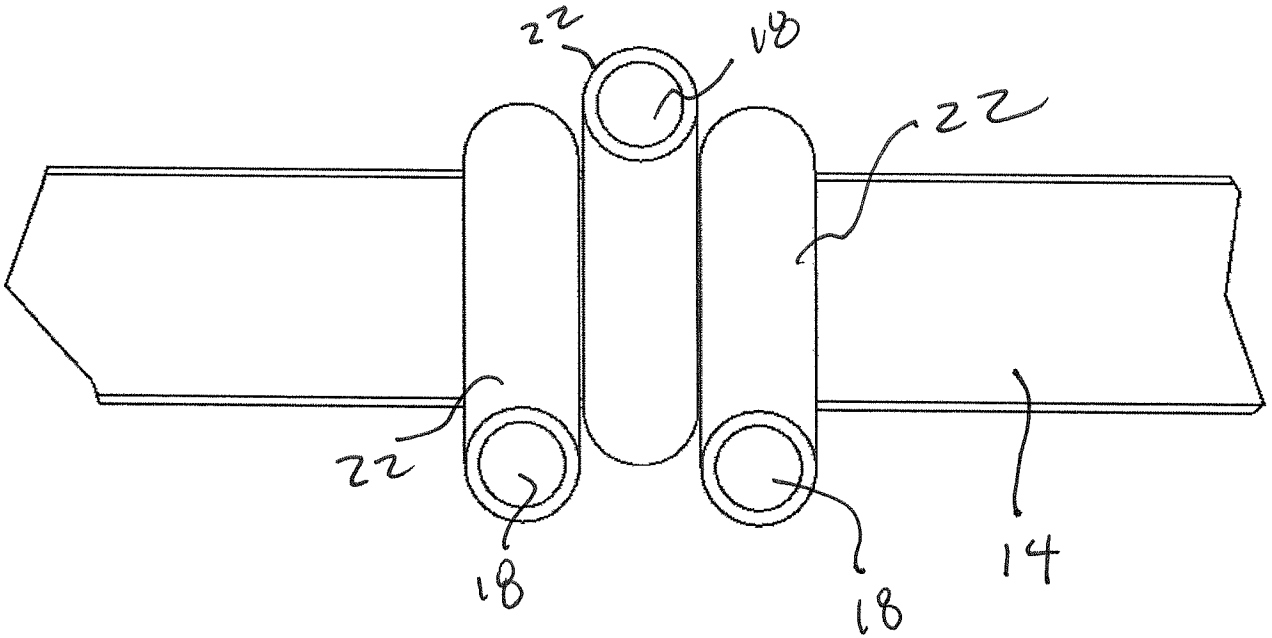
FIG. 7 is an enlarged cross-sectional view taken along the longitudinal axis (i.e., an axis extending parallel to the warp wires) of a portion of the preferred embodiment depicted in FIG. 6.
Figure 6:
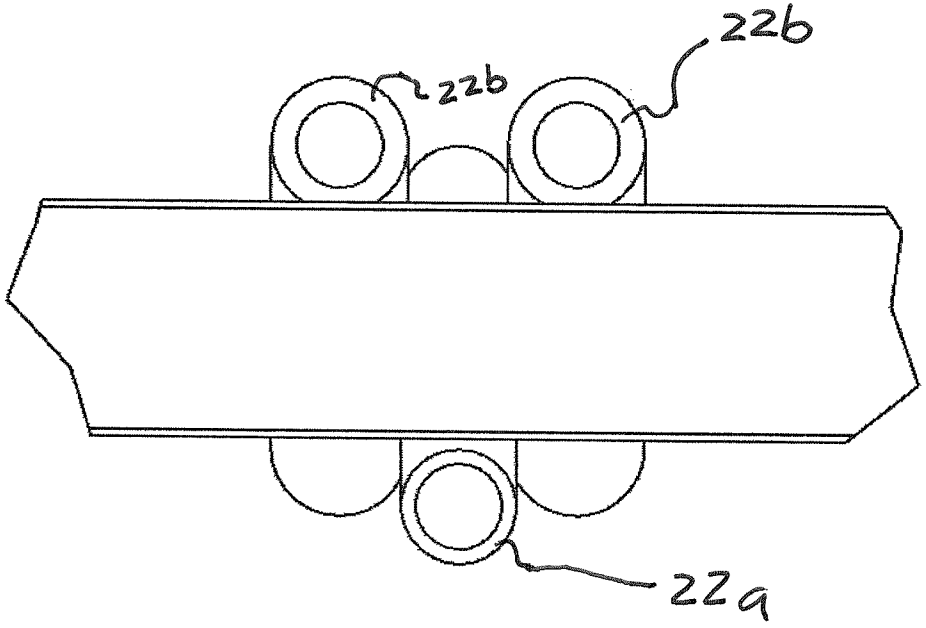

Referring to FIGS. 6 and 7, a woven wire screening or screen B formed in accordance with another preferred embodiment of the present invention is illustrated in one of many possible configurations. Screen B includes a first set of warp wires 14 and a second set of warp wires 16. Warp wires 14 are straight wires and warp wires 16 are crimped wires. Screen B further includes a plurality of weft wires 18 grouped in at least threes as seen in FIG. 6. The warp wires 14 and 16 and the weft wires 18 are interwoven to form a screening having a plurality of substantially triangular openings 20. However, it should be readily appreciated that the configuration of openings 20 may be varied as desired. The distance between groups of three or more weft wires is considerably greater than the distance between each weft wire in a grouping of three or more weft wires as seen in FIG. 6. The wires of screen B may have a circular cross-section or may be shaped wires having two substantially flat vertically extending sidewalls. Alternatively, some wires of screen B may have a circular cross-section while other wires of screen B are shaped wires having two substantially flat vertically extending sidewalls. Other wire configurations may be used as desired.

Figure 9:
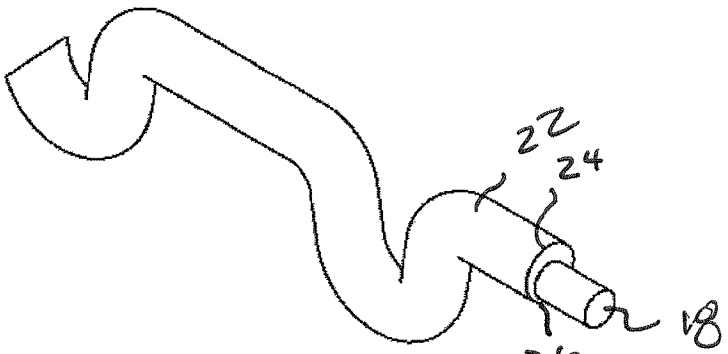
FIG. 9 is an enlarged perspective view of a weft wire of the woven wire screen of FIG. 6 with another alternative coating for the weft wires.
Figure 10:
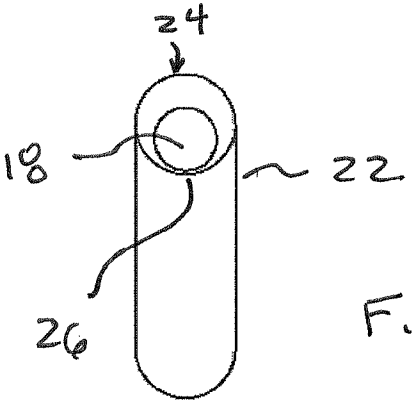
FIG. 10 is an enlarged end view of a weft wire of the woven wire screen of FIG. 9.

Preferably, each of the weft wires 18 are individually coated with a protective coating 22. The coating can be applied prior or subsequent to weaving of the warp and weft wires. The individually coatings 18 increase the relative movement of the warp wires to enhance performance of the screening. Coating 18 is preferably formed from a flexible material that expands and collapses during use of the screening to further enhance the relative movement of the warp wires 18 to enhance performance of the screening. However, the hardness characteristic of the coating may be varied as desired. The coating 18 may be formed from any suitable material including but not limited to polyurethane. As seen in FIGS. 9 and 10, the coating 22 may be applied to the weft wires 18 such that the center of the coating 22 is offset upwardly from the center of weft wires 18. Referring to FIGS. 9 and 10, this orientation of the coating and the corresponding weft wire results in the coating portion 24 formed about the top of weft wires 18 having a thickness greater than coating portion 26 formed about the bottom of weft wires 18. This configuration increases the height differential between the uppermost portion of the coated weft wires 18 and the uppermost portion of warp wires 14 and 16 to improve the tumbling action of objects impacting the screen during use of the screen to classify material flowing through the screen. As shown in FIG. 8, the thickness of the coating 22*a* applied to one of the three weft wires may differ from the coatings 22*b* of the other two weft wires in a grouping of three or more weft wires to create a height differential between an uppermost portion of one weft wire and an uppermost portion of the other two weft wires in a grouping of three or more weft wires to improve the tumbling action of objects impacting the screen during use of the screen to classify material flowing through the screen. Alternatively, each weft wire 18 in a group of three or more weft wires may have a coating of a different thickness than the coating thickness of every other weft wire in a group of three or more weft wires. As shown in FIG. 7, the center of coating 22 can be aligned with the center of the corresponding weft wire 18. While this configuration will increase the height differential between the uppermost portion of the coated weft wires and the uppermost portion of warp wires, the height differential is not a great as when the center of the coating is offset upwardly from the center of the corresponding wire.

The warp wires 14 and 16 may be individually coated with any suitable material. The coating of the warp wires 14 and 16 may differ in at least one characteristic from the coatings formed on weft wires 18 to improve performance of the screen. For example, the coating applied to warp wires 14 and 16 may have a lower coefficient of friction than the coating formed on the weft wires 18 to facilitate objects passing through openings 20. The coating on the warp wires could be formed from TEFLON or a material having a similar coefficient of friction to TEFLON. Ribs or protrusions may be formed in the upper portions of the coatings formed on the weft wires 18 and/or the warp wires 14 and 16 to improve the tumbling action of the screen. It should be noted that where the warp wires are individually coated, the weft wires 18 could be replaced with urethane blocks as the sole means for binding the warp wires together, i.e., no weft or fill wires are present in screen B. In this instance, the coatings of one or more warp wires may differ in at least one characteristic from one or more of the other warp wires. For example, warp wires 14 could have a coating with an uppermost surface raised above the uppermost surface of warp wires 16 creating a height differential between adjacent warp wires to improve the tumbling action of the screen. This height differential can be achieved in a number of ways. For example, the coating thickness of every other warp wire could be greater than the coating thickness of the directly adjacent warp wires. Alternatively, every other warp wire could have a coating formed about the wire in the manner shown in FIGS. 9 and 10 and the directly adjacent warp wires could have a coating formed in the manner depicted in FIG. 7 where the diameters of all coatings on the warp wires are the same size.

Figure 11:
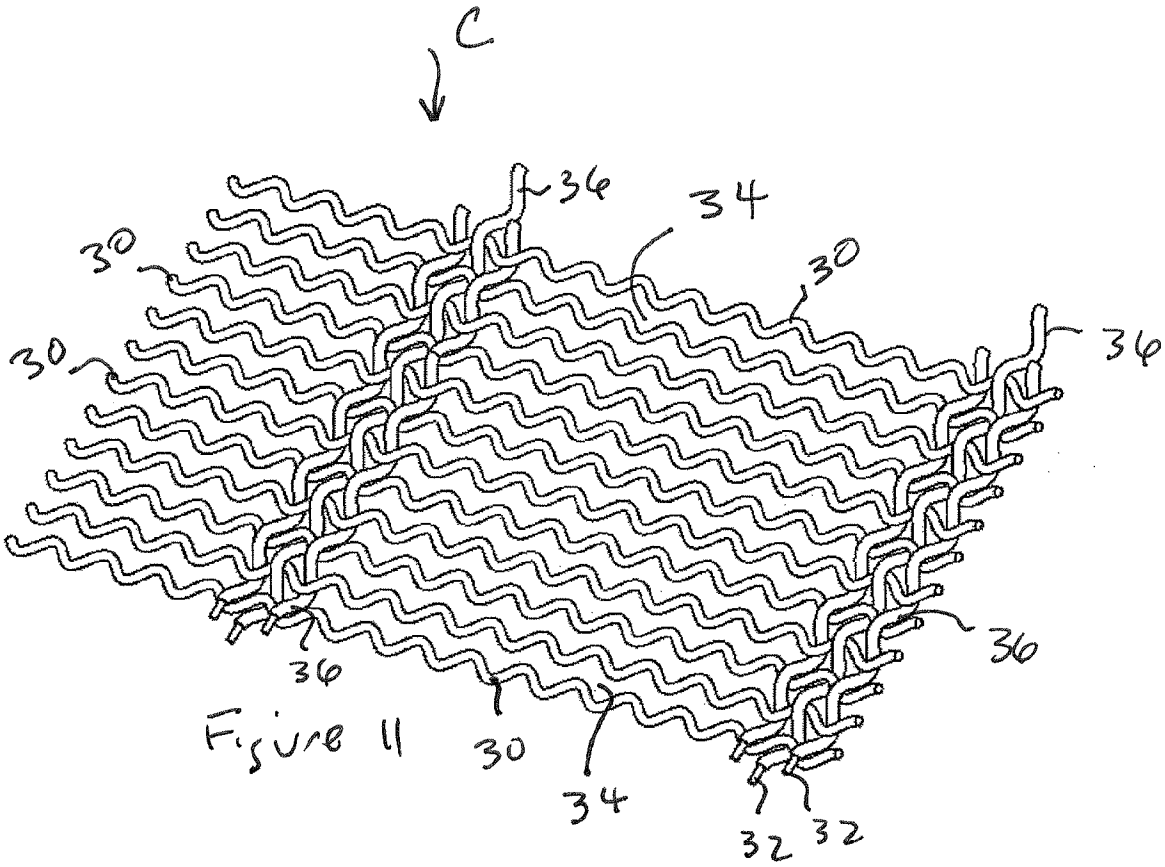
FIG. 11 is a perspective view of a portion of a woven wire screening formed in accordance with another preferred embodiment of the present invention where the weft wires are individually coated with a flexible material and the warp wires are preferably uncoated.
Figure 12:
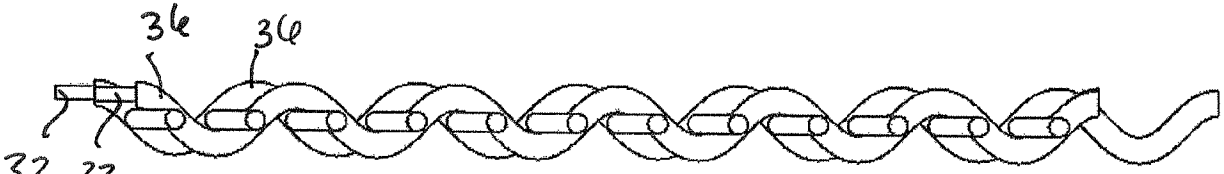
FIG. 12 is a cross-sectional view taken along the transverse axis (i.e., an axis extending parallel to the weft wires) of the preferred embodiment depicted in FIG. 11.

FIGS. 11 and 12

Referring to FIGS. 11 and 12, a woven wire screening or screen C formed in accordance with a further preferred embodiment of the present invention is illustrated in one of many possible configurations. Screen A includes a plurality of warp wires 30 and a plurality of weft wires 32. Weft wires 32 are also referred to as fill wires. The weft or fill wires 32 and the warp wires 30 are interwoven to form a plurality of elongated slot type openings 34. However, the shape of the openings can be readily varied as desired. The weft wires 32 and the warp wires 30 can have a circular cross-section. Alternatively, warp wires 30 and/or weft wires 32 can be shaped wires having two substantially flat vertically extending side walls. Other wire configurations may be used as desired.

Preferably, the weft wires 32 are grouped in sets of three or more weft wires. The distance between groups of weft wires is considerably greater than the distance between each weft wire in a grouping of weft wires as seen in FIG. 11. Preferably, each of the weft wires 32 are individually coated with a protective coating 36. The coating can be applied prior or subsequent to weaving of the warp and weft wires. The individually coatings 36 increase the relative movement of the warp wires 30 to enhance performance of the screening. Coating 36 is preferably formed from a flexible material that expands and collapses during use of the screening to further enhance the relative movement of the warp wires 30 to enhance performance of the screening. However, the hardness characteristic of the coating may be varied as desired. The coating 36 may be formed from any suitable material including but not limited to polyurethane. As seen in FIGS. 2 through 4, the coating 36 may be applied to the weft wires 32 such that the center of the coating 36 is offset upwardly from the center of weft wires 32. Referring to FIGS. 2 to 4, this orientation of the coating and the corresponding weft wire results in the coating portion formed about the top of weft wires having a thickness greater than the coating portion formed about the bottom of weft wire. Orienting the coating and corresponding wire in this manner further increases the height differential between the uppermost portion of the coated weft wires and the uppermost portion of warp wires to improve the tumbling action of objects impacting the screen during use of the screen to classify material flowing through the screen.

As shown in FIG. 8, the thickness of the coating applied to one of the three or more weft wires may differ from the other two weft wires in a grouping of three or more weft wires to create a height differential between an uppermost portion of one weft wire and an uppermost portion of the other two weft wires in a grouping of three or more weft wires to improve the tumbling action of objects impacting the screen during use of the screen to classify material flowing through the screen. Alternatively, each weft wire in a group of three or more weft wires may have a coating of a different thickness than the coating thickness of every other weft wire in a group of three or more weft wires. As shown in FIG. 5, the center of coating can be aligned with the center of the corresponding weft wire. While this configuration will increase the height differential between the uppermost portion of the coated weft wires and the uppermost portion of the warp wires, the height differential is not a great as when the center of the coating is offset upwardly from the center of the corresponding wire.

The warp wires 30 may be individually coated with any suitable material. The coating of the warp wires 30 may differ in at least one characteristic from the coatings formed on weft wires 32 to improve performance of the screen. For example, the coating applied to warp wires 30 may have a lower coefficient of friction than the coating formed on the weft wires 32 to facilitate objects passing through openings 34. The coating on warp wires could be formed from TEFLON or a material having a similar coefficient of friction to TEFLON. Ribs or protrusions may be formed in the upper portions of the coatings formed on the weft wires 32 and/or the warp wires 30 to improve the tumbling action of the screen. It should be noted that where the warp wires are individually coated, the weft wires 32 could be replaced with urethane blocks as the sole means for binding the warp wires together, i.e., no weft or fill wires are present in screen C. In this instance, the coatings of one or more warp wires may differ in at least one characteristic from one or more of the other warp wires. For example, every other warp wire could have a coating with an uppermost surface raised above the uppermost surface of a directly adjacent warp wire creating a height differential between adjacent warp wires to improve the tumbling action of the screen. This height differential can be achieved in a number of ways. For example, the coating thickness of every other warp wire could be greater than the coating thickness of the directly adjacent warp wires. Alternatively, every other warp wire could have a coating formed about the wire in the manner shown in FIGS. 2 through 4 and the directly adjacent warp wires could have a coating formed in the manner depicted in FIG. 5 where the diameters of all coatings on the warp wires are the same size.

FIGS. 13-18

Referring to FIGS. 13 to 18, a woven wire screening or screen D formed in accordance with a further preferred embodiment of the present invention is illustrated in one of many possible configurations. Screen D includes a plurality of warp wires 40 and a plurality of weft wires 42 interwoven to form an interwoven screen having a plurality of square openings 44. Preferably, the weft wires 42 are uniformly spaced along the length of the warp wires 40. Preferably, the weft wires have a crimped depth greater than the crimp depth of the warp wires creating a height differential between the uppermost portion of the weft wires and the uppermost portion of the warp wires (i.e., the uppermost portion of the weft wires are raised above the uppermost portion of the warp wires) as seen in, for example, FIGS. 14 and 15.

Figure 13:
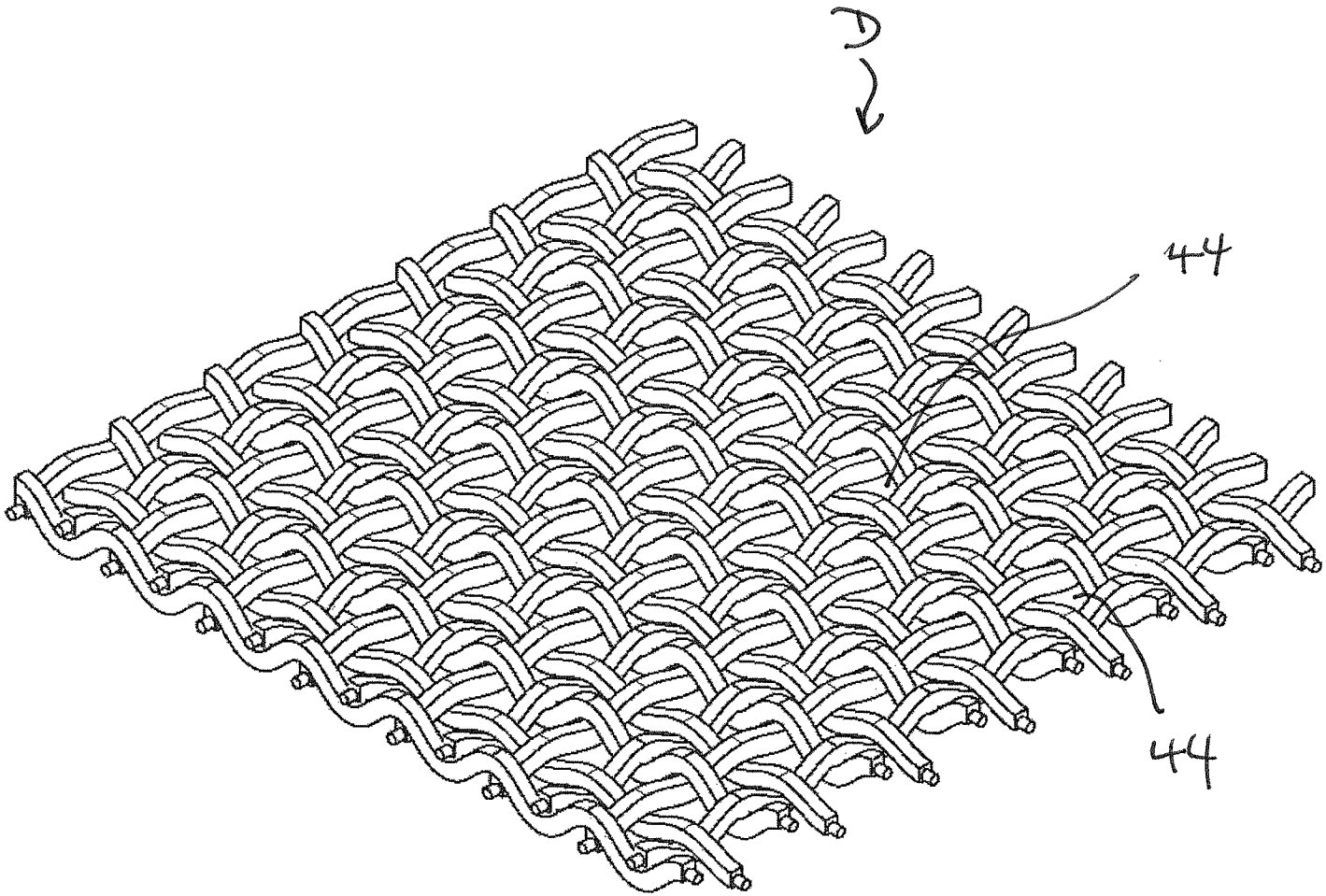
FIG. 13 is a perspective view of a portion of a woven wire screening formed in accordance with another preferred embodiment of the present invention where the weft wires and the warp wires are individually coated with a flexible material.
Figure 14:
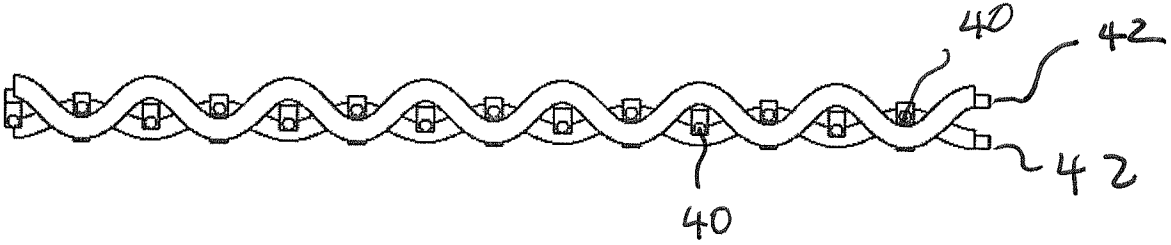
FIG. 14 is a cross-sectional view taken along the traverse axis (i.e., an axis extending parallel to the weft wires) of the preferred embodiment depicted in FIG. 13.
Figure 15:
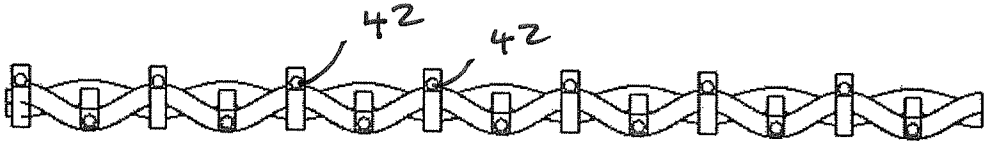
FIG. 15 is a cross-sectional view taken along the longitudinal traverse axis (i.e., an axis extending parallel to the warp wires) of the preferred embodiment depicted in FIG. 13.
Figure 17:
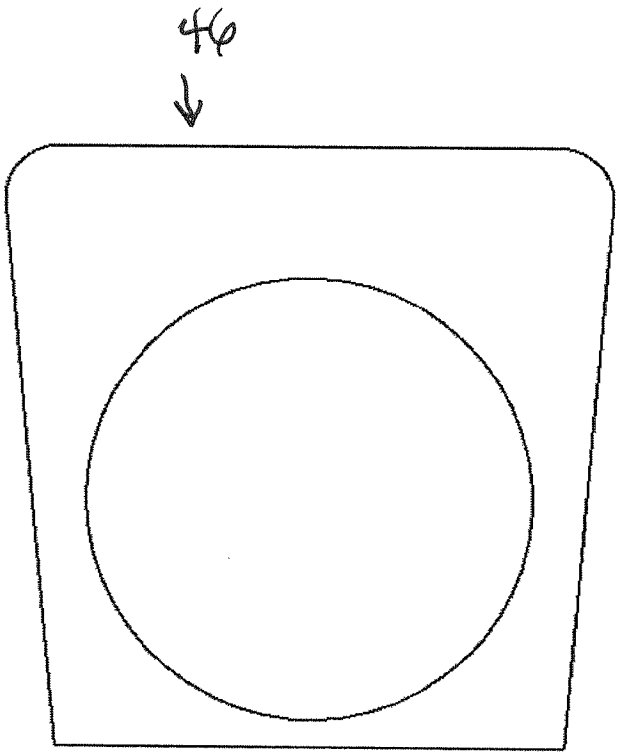
Figure 14:
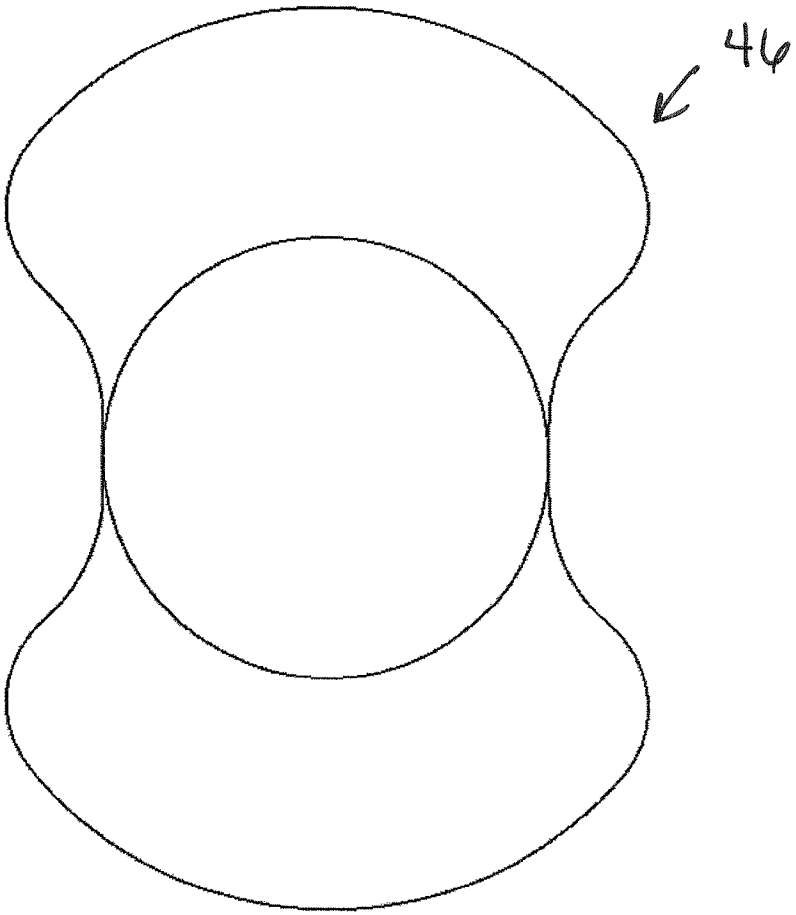
Figure 18:
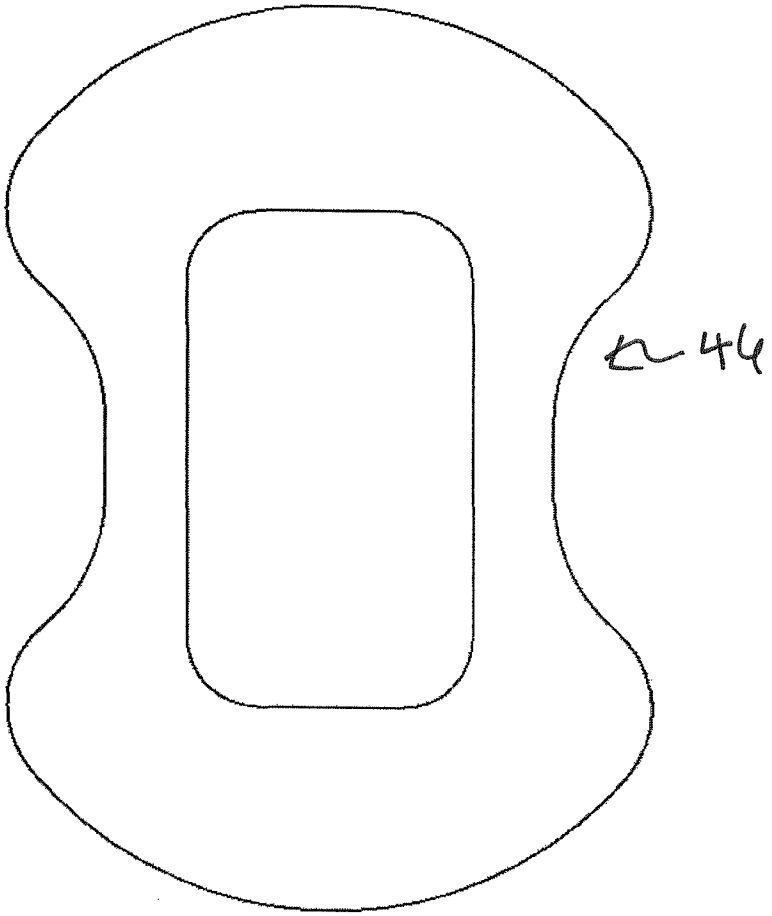

Each of the warp wires and the weft wires are preferably individually coated with a protective coating 46. As seen in FIGS. 13 to 15, the coating 46 can have a rectangular configuration. The center of the coating 46 may be aligned with or offset upwardly from the center of the corresponding wire. The coating may be formed from any suitable material including but not limited to the polyurethane. Preferably, the coating is formed from a flexible material that expands and compresses when the screen is in use to allow relative movement between adjacent wires. This is a significant improvement over other square opening screens which do not allow for relative motion between adjacent wires when the screen is in use. The hardness of coatings of adjacent wires may be varied to vary the relative motion between adjacent wires to improve the ability of screen to clean itself (i.e., self-cleaning). The coating can be applied prior or subsequent to weaving of the warp and weft wires. As seen in FIGS. 16 through 18, the coatings may have a non-uniform and/or non-circular thickness around the perimeter of the coating. As seen in FIG. 16, the thickness of the portion of the coating horizontally aligned with the center of the corresponding wire may be significantly reduced from the thickness of the portion of the coating vertically aligned with the center of the corresponding wire. Additionally, the coating may be formed such that the outer area of the corresponding wire horizontally aligned with the center of the wire has no coating, i.e., a small portion of the outer perimeter of the wire is exposed. The shape of the coatings may be varied to improve the tumbling action of the screen. For example, some of the weft wires could have a coating configuration different from other weft wires. Alternatively, some of the warp wires could have a coating configuration different from other warp wires. Further, the coating configuration of the warp wires may differ from the weft wires.

The height differential of the weft wires and the warp wires can be increased by providing the weft wires with coatings having a thickness greater than the thickness of the coatings of the warp wires. The height differential of the weft wires and the warp wires can be increased using the same size coatings on the warp and weft wires by forming the coatings of the weft wires in the manner depicted in FIGS. 2 to 4 while forming the coatings on the warp wires in the manner depicted in FIG. 7. It should be noted that a height differential between adjacent warp wires can be created by varying the thickness of coatings applied to the adjacent warp wires. A height differential between adjacent warp wires can be created by forming the coating of one warp wire in the manner depicted in FIGS. 2 to 4 while forming the coating on an adjacent warp wire in the manner depicted in FIG. 7. A height differential between adjacent weft wires can be created in either manner described to create a height differential between adjacent warp wires. By varying the thickness or orientation of the coating on the corresponding wire applied to each of the four wires forming each square opening, it is possible to achieve a screen where each of the wires forming each square opening has an uppermost portion offset horizontally from the uppermost portion of each of the other wires forming the square opening to improve the tumbling action of the screen. The tumbling action and/or performance of the screen may be improved by varying at least one characteristic of the coatings applied to the warp wires and/or the weft wires. The at least one characteristic may be one or more of the following: (i) thickness; (ii) material; (iii) flexibility/hardness; (iv) shape; and, (v) orientation of the center of the coating relative to the center of the corresponding wire.

FIGS. 19-21

Figure 19:
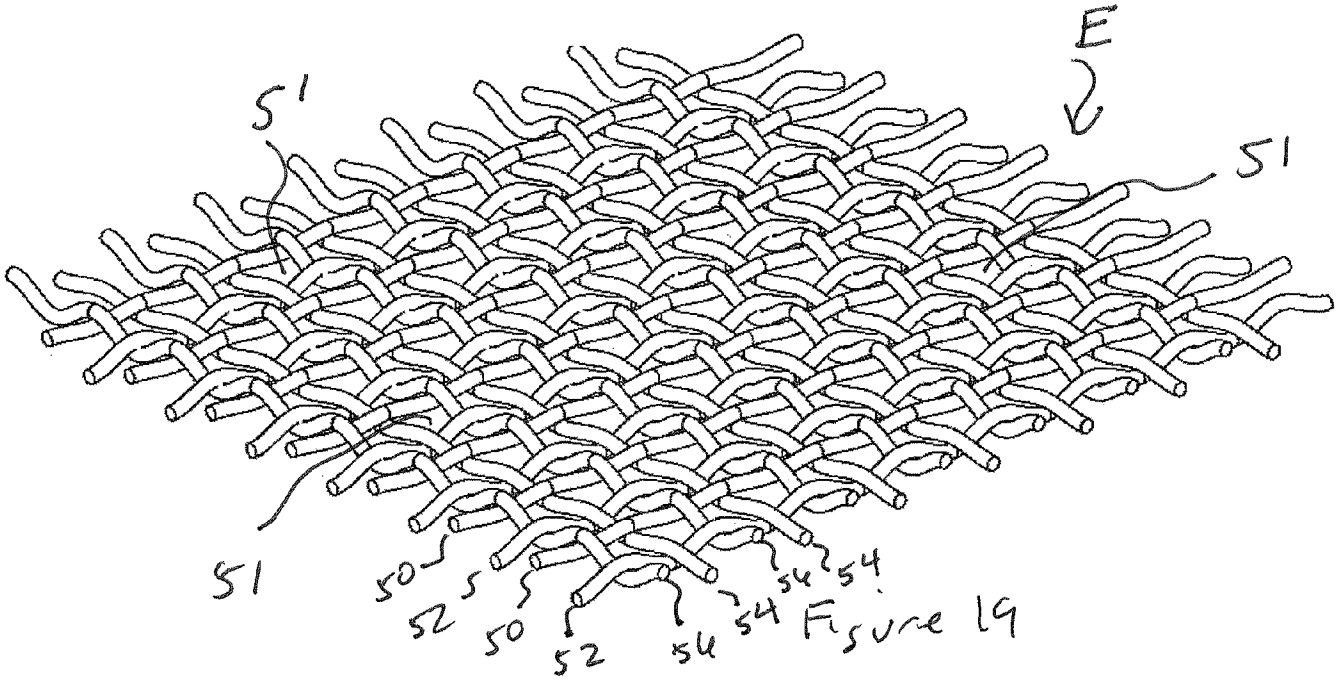
FIG. 19 is a perspective view of a portion of a woven wire screening formed in accordance with another preferred embodiment of the present invention where the warp and weft wires are each preferably uncoated.
Figure 20:
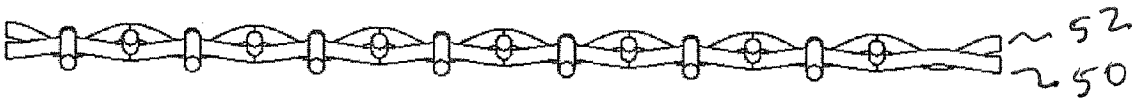
FIG. 20 is a cross-sectional view taken along the traverse axis (i.e., an axis extending parallel to the weft wires) of a variation of the woven wire screening depicted in FIG. 19.
Figure 21:
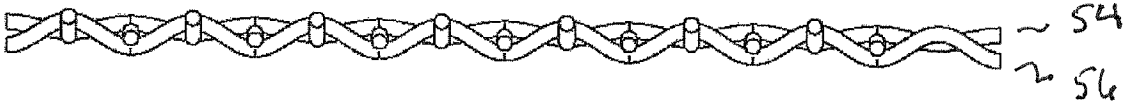
FIG. 21 is a cross-sectional view taken along the longitudinal axis (i.e., an axis extending parallel to the warp wires) of a variation of the woven wire screening depicted in FIG. 19.

Referring to FIGS. 19 to 21, a woven wire screening or screen E formed in accordance with a further preferred embodiment of the present invention is illustrated in one of many possible configurations. Screen E includes a plurality of warp wires and a plurality of weft wires forming an interwoven screening with a plurality of square openings 51. The wires of screen E may have a circular cross-section or may be shaped wires having two substantially flat vertically extending sidewalls. Alternatively, some wires of screen E may have a circular cross-section while other wires of screen E are shaped wires having two substantially flat vertically extending sidewalls. Other wire configurations may be used as desired.

The even number weft wires (i.e., second, fourth, etc.) 50 have a first different crimp depth that is less than the second crimp depth of the odd weft wires (i.e., first, third, etc.) 52. The even number warp wires (i.e., second, fourth, etc.) 54 have a third different crimp depth that is less than the fourth crimp depth of the odd warp wires (i.e., first, third, etc.) 56. The first, second, third and fourth crimp depths are all different crimp depths, i.e., none of the first, second, third and fourth crimp depths are the same. In this manner, each of the four wires forming each of the square openings 51 of screen E have an uppermost portion that is vertically offset from the uppermost portion of each of the other wires forming each of the square openings 51. It should be noted that the crimp depths of the even and odd warp wires and weft wires may be varied from that previously described provided that each of the four wires forming each of the square openings 51 of screen E have an uppermost portion that is vertically offset from the uppermost portion of each of the other wires forming each of the square openings 51. While the warp and weft wires as shown in FIGS. 19 to 21 are uncoated, the warp and/or weft wires may be coated in any manner previously described.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. A woven wire screening for use in classifying material flowing through said woven wire screening; said woven wire screening comprising:

(a) a set of warp wires, each warp wire in said set of warp wires extending parallel to all other warp wires in said set of warp wires, at least two warp wires in said set of warp wires being crimped wires;

(b) a first set of crimped weft wires extending perpendicular to said set of warp wires and a second set of crimped weft wires extending perpendicular to said set of warp wires, said set of warp wires, said first set of crimped weft wires and said second set of crimped weft wires being interwoven to form an integral wire cloth having a plurality of openings for permitting material to be classified to flow through said openings, said first and second sets of crimped weft wires each including at least three crimped weft wires, one of said crimped weft wires in said first set of crimped weft wires being spaced from an adjacent crimped weft wire in said first set of crimped weft wires a first distance and said first set of crimped weft wires being spaced from said second set of crimped weft wires a second distance wherein said second distance is greater than said first distance and no weft wires are positioned between said first set of crimped weft wires and said second set of crimped weft wires; and (c) at least three individual protective coatings wherein each individual protective coating of said at least three individual protective coatings coats only one of said at least three crimped weft wires in said first set of crimped weft wires such that each of said at least three crimped weft wires in said first set of crimped weft wires has a separate coating from each of the other of said at least three crimped weft wires in said first set of crimped weft wires, each of said at least three individual protective coatings being formed from a non-metallic material.

2. The woven wire screening of claim 1, wherein:

(a) each wire in said set of warp wires is a non-coated metallic wire.

3. The woven wire screening of claim 1, wherein:

(a) said set of warp wires includes at least two straight wires.

4. The woven wire screening of claim 1, wherein:

(a) each individual protective coating of said at least three individual protective coatings is formed from a flexible material that compresses and expands during use of the woven wire screening to classify material.

5. The woven wire screening of claim 1, wherein:

(a) said at least three individual protective coatings includes a first individual protective coating which has at least one characteristic that differs from at least one other of said at least three individual protective coatings.

6. The woven wire screening of claim 5, wherein:

(a) the at least on characteristic is coating thickness.

7. The woven wire screening of claim 1, wherein:

(a) said at least three individual protective coatings includes a first individual protective coating formed on a first crimped weft wire, a center point of said first individual protective coating being offset from a center point of said first crimped weft wire.

8. The woven wire screening of claim 1, wherein:

(a) said at least three individual protective coatings includes a first individual protective coating formed on a first crimped weft wire such that a first portion of said first individual protective coating formed on a top surface of said first crimped weft wire has a thickness greater than a second portion of said first individual protective coating formed on a bottom surface of said first crimped weft wire.

9. A wire screening for use in classifying material flowing through said wire screening; said wire screening comprising:

(a) a set of wires, each wire in said set of wires extending parallel to all other wires in said set of wires;

(b) a set of members extending perpendicular to said set of wires, said set of wires and said set of members being connected to form an integral wire cloth having a plurality of openings for permitting material to be classified to flow through said openings; and (c) an individual protective coating formed on each of said wires in said set of wires, said individual protective coating being formed from a non-metallic material and having a thickness which varies over a perimeter of said individual protective coating such that a first portion of said individual protective coating formed on a first portion of a corresponding wire has a thickness greater than a second portion of said individual protective coating formed on a second portion of the corresponding wire.

10. The wire screening as set forth in claim 9, wherein:

(a) said set of wires are warp wires and said set of members includes a plurality of spaced polyurethane binding blocks formed about said set of warp wires.

11. The wire screening as set forth in claim 10, wherein:

(a) said set of members includes a plurality of weft wires embedded in each of said plurality of spaced polyurethane binding blocks.

12. The wire screening as set forth in claim 9, wherein:

(a) said set of wires are weft wires.

13. A woven wire screening for use in classifying material flowing through said woven wire screening; said woven wire screening comprising:

(a) a set of warp wires, each warp wire in said set of warp wires extending parallel to all other warp wires in said set of warp wires;

(b) a set of weft wires extending perpendicular to said set of warp wires, said set of warp wires and said set of weft wires being interwoven to form an integral wire cloth having a plurality of openings for permitting material to be classified to flow through said openings; and (c) an individual protective coating formed on one of the following: (i) each of said warp wires in said set of warp wires and (ii) each of said weft wires in said set of weft wires, said individual protective coating being formed from a non-metallic material and having a non-circular cross-section with a first portion of said individual protective coating being formed on a top surface of a corresponding wire and a second portion of said individual protective coating being formed on a bottom surface of the corresponding wire.

14. The woven wire screening as set forth in 13, wherein:

(a) said individual protective coating is formed on each of said warp wires in said set of warp wires and each of said weft wires in said set of weft wires.

15. The woven wire screening as set forth in claim 14, wherein:

(a) said individual protective coating formed on said set of weft wires has at least one characteristic which differs from said individual protective coating formed on said set of warp wires.

16. The woven wire screening as set forth in claim 15, wherein:

(a) the at least one characteristic is one of the following: (i) thickness; (ii) material; and (iii) flexibility.

17. A wire screening for use in classifying material flowing through said wire screening; said wire screening comprising:

(a) a set of wires, each wire in said set of wires extending parallel to all other wires in said set of wires;

(b) a set of members extending perpendicular to said set of wires, said set of wires and said set of members being connected to form an integral wire cloth having a plurality of openings for permitting material to be classified to flow through said openings; and (c) a first set of individual protective coatings wherein one individual protective coating of said first set of individual protective coatings being formed on each of said wires in said set of wires, at least one individual protective coating in said first set of individual protective coatings having at least one characteristic that differs from another individual protective coating in said first set of individual protective coatings.

18. The wire screening of claim 17, wherein:

(a) said set of wires are weft wires.

19. The wire screening of claim 18, wherein:

(a) the at least one characteristic is coating thickness.

20. The wire screening of claim 17, wherein:

(a) said set of wires are warp wires.

21. The wire screening of claim 17, wherein:

(a) said set of members are weft wires.

22. A woven wire screening for use in classifying material flowing through said woven wire screening; said woven wire screening comprising:

(a) a first set of wires, each wire in said first set of wires extending parallel to all other wires in said first set of wires;

(b) a second set of wires extending perpendicular to said first set of wires, said first set of wires and said second set of wires being interwoven to form an integral wire cloth having a plurality of openings for permitting material to be classified to flow through said openings; and (c) said plurality of openings including a first opening formed from two wires of said first set of wires and two wires from said second set of wires and wherein each wire forming said first opening having a crimp depth different from a crimp depth of each other wire forming said first opening so that each of the four wires forming the first opening has an uppermost portion that is vertically offset from an uppermost portion of each of the other wires forming the first opening.

23. The woven wire screening of claim 22, wherein:

(a) said plurality of openings are substantially square openings.

24. A woven wire screening for use in classifying material flowing through said woven wire screening; said woven wire screening comprising:

(a) a first set of wires, each wire in said first set of wires extending parallel to all other wires in said first set of wires;

(b) a second set of wires extending perpendicular to said first set of wires, said first set of wires and said second set of wires being interwoven to form an integral wire cloth having a plurality of openings for permitting material to be classified to flow through said openings; and (c) a first set of individual protective coatings wherein one individual protective coating of said first set of individual protective coatings being formed on each of said wires in said first set of wires; and, (d) a second set of individual protective coatings wherein one individual protective coating of said second set of individual protective coatings being formed on each of said wires in said second set of wires, at least one individual protective coating in said first set of individual protective coatings having at least one characteristic that differs from at least one individual protective coating of said second set of individual protective coatings.

25. The woven wire screening as set forth in claim 24, wherein:

(a) the at least one characteristic is one of the following: (i) thickness; (ii) material;

and (iii) flexibility.

26. The woven wire screening as set forth in claim 25, wherein:

(a) said first set of wires are warp wires and said second set of wires are weft wires and the at least one characteristic is thickness of a top portion of the individual protective coatings formed on a top surface of each of said warp wires and thickness of a top portion of the individual protective coatings formed on a top surface of each of said weft wires.

* * * * *